United States Patent [19]

Bächler et al.

[11] Patent Number: 4,614,093

[45] Date of Patent: Sep. 30, 1986

[54] METHOD OF STARTING AND/OR REGENERATING A CRYOPUMP AND A CRYOPUMP THEREFOR

[75] Inventors: Werner Bächler, Rösrath; Hans-Joachim Forth, Cologne; Hans-Hermann Klein, Rösrath, all of Fed. Rep. of Germany

[73] Assignee: Leybold-Heraeus GmbH, Cologne, Fed. Rep. of Germany

[21] Appl. No.: 788,769

[22] Filed: Oct. 18, 1985

[30] Foreign Application Priority Data

Apr. 6, 1985 [DE] Fed. Rep. of Germany ..... 3512614

[51] Int. Cl.[4] ..... B01D 8/00

[52] U.S. Cl. ..... 62/55.5; 55/269; 62/100; 62/268; 417/901

[58] Field of Search ..... 62/55.5, 100, 268; 417/901; 55/269

[56] References Cited

U.S. PATENT DOCUMENTS

| | | | |
|---|---|---|---|
| 3,585,807 | 6/1971 | Hengevoss | 62/55.5 |
| 4,121,430 | 10/1978 | Bachler | 62/55.5 |
| 4,150,549 | 4/1979 | Longsworth | 62/55.5 |
| 4,283,948 | 10/1981 | Welch | 62/55.5 |
| 4,356,701 | 11/1982 | Bartlett et al. | 62/55.5 |
| 4,363,217 | 12/1982 | Venuti | 62/55.5 |
| 4,438,632 | 3/1984 | Lessard et al. | 62/55.5 |
| 4,454,722 | 6/1984 | Bartlett et al. | 62/55.5 |
| 4,546,613 | 10/1985 | Eacobacci et al. | 62/55.5 |

*Primary Examiner*—Ronald C. Capossela
*Attorney, Agent, or Firm*—Felfe & Lynch

[57] ABSTRACT

A cryopump has a two-stage refrigerator in a housing with a pumping surface area in thermal communication with each stage of the refrigerator for gas-pumping by adsorption or absorption when the refrigerator is operated. A roughing vacuum pump provides a pressure of from about 1 to about $10^{-3}$ mbar to the housing and at least the pumping surface area of the second refrigerator stage is heated sufficiently to prevent gas adsorption or absorption thereon before the cryopump is operatively connected to a space to be evacuated therewith as a starting method for improving the cryopumping of, particularly, helium and a regenerating method after use of the cryopump.

17 Claims, 1 Drawing Figure

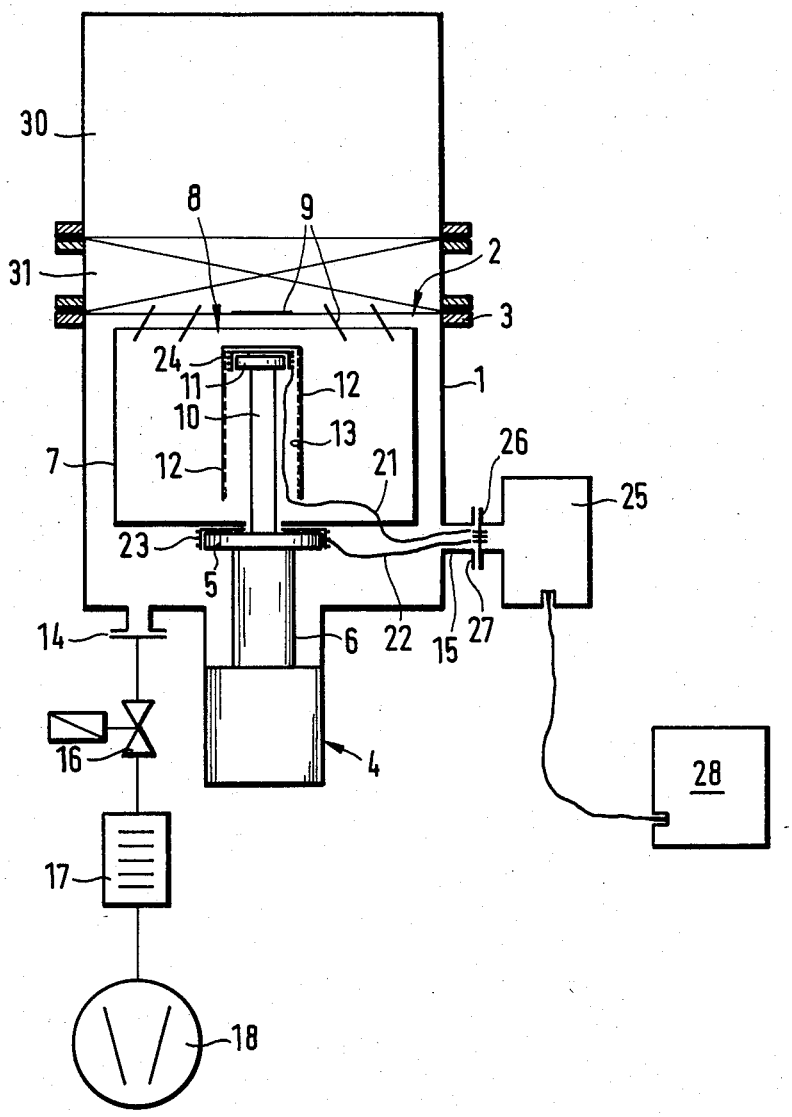
30
8
9
31
2
3
24
11
12
1
10
13
7
12
21
26
25
23
5
22
15
27
14
6
16
4
28
17
18

METHOD OF STARTING AND/OR REGENERATING A CRYOPUMP AND A CRYOPUMP THEREFOR

BACKGROUND OF THE INVENTION

The invention relates to a method of starting and/or regenerating a cryopump and a cryopump therefor.

A cryopump or cryogenic pump is a temperature (cold) operated vacuum pump. Cryopumps having two-stage refrigerator operation are disclosed in published German patent applications DOS 26 20 880, 28 21 276 and 30 38 415. Each of these has three surface areas for adsorption or absorption of various types of gases.

The first surface area is in good thermal contact communication with the first stage of the refrigerator, which, in operation, has a substantially-constant temperature between 60° and 100° K., depending on the type and capacity of the refrigerator, and has a conductivity appropriate to provide a corresponding, substantially-constant temperature with only a small temperature gradient across the surface area. A metal having appropriate thermal conductivity is, therefore, generally used for its structure which may also serve as a baffle that protects other, lower-temperature refrigerator-pumping surfaces from incident heat radiation. The main purpose of the first surface area is, however, to adsorb water vapor and carbon dioxide by cryocondensation. Cryocondensation occurs when gases impinge on a sufficiently-cold homogeneous surface and condense on it into the liquid or solid phase. The binding forces are of a physical nature, and the binding energy corresponds to the heat of vaporization.

The second surface area has similar good thermal contact communication and conductivity, but with the second stage of the refrigerator to be at its colder temperature and, therefore, is likewise generally a metal surface. It is intended for removing argon, carbon monoxide, methane and halogenated hydrocarbons, and, perhaps, hydrogen, for example, by cryocondensation and cryotrapping. Cryotrapping is a process in which lower-boiling and, therefore, more-difficultly condensable gases impinge on a sufficiently-cold surface simultaneously with more-readily condensable gases and the more-difficultly condensable gas are absorbed in the steadily growing condensate layer of the more-readily condensable gas.

The third surface area is also at the temperature of the second stage of the refrigerator (or at a correspondingly lower temperature in the case of a three-stage refrigerator) and is coated with an adsorbent such as activated charcoal or the like. It is intended essentially for removing lighter gases such as hydrogen, helium and neon by cryosorption. Cryosorption occurs when gases impinge on an adsorbent-coated and, thus, heterogeneous surface and are bound by unsaturated residual valences of the interfacial atoms of the surface. The third surface area is, therefore, arranged in such a way that gases can reach it only by "detours" or a circuitous route which the lighter gases can traverse by diffusion but heavier gases practically cannot so that they condense on the more-readily-reachable cryocondensation and cryotrapping surfaces. Premature contamination of the adsorbent with heavy gases is thus prevented to preserve its surface-atom-dependnet pumping activity for the lighter gases for a longer time.

Nevertheless, the pumping capacity of the cryopumps disclosed in the above patent publications and other known cryopumps for helium is quite poor because of the very low boiling point of helium. To improve the helium pumping capacity, therefore, cryopumps with a three-stage refrigerator or with a two-stage refrigerator and a Joule-Thompson stage have been proposed to achieve lower temperatures for the cryosorption pumping surfaces. However, these approaches are extremely complicated technically and, therefore, expensive.

SUMMARY OF THE INVENTION

An object of the invention is, therefore, to provide a method of starting a cryopump having a two-stage refrigerator which improves its capacity for pumping helium and other, mainly-light gases.

Another object of the invention is, therefore, to provide a cryopump for practicing the method.

In accordance with the invention, these and other objects are achieved by evacuating a housing about a two-stage refrigerator of a cryopump to a pressure of from about 1 to about $10^{-3}$ mbar and heating at least one pumping surface area of at least the second stage of the refrigerator at least just before, i.e. by the time the pump is operatively connected to the space to be evacuated with the cryopump at least sufficiently to prevent gas adsorption and absorption thereon. With appropriate heating, these steps serve to prepare the heated pumping surface area or areas optimally for the ensuing adsorption and absorption pumping processes when the cryopump is operatively connected to the space to be evacuated.

Both second and third second-stage pumping surface areas which are uncoated and coated with an adsorbent are preferably heated to 70° C. during the startup time before the cryopump is operatively connected to the space to be evacuated, but the third, absorbent-coated pumping surface area is particularly intended. The first-stage pumping surface area may also be heated to 70° C. during this time. Heaters may be required for this, particularly if the refrigerator is also operated during the startup time as preferred for the reasons described below.

The heater for the second-stage pumping surface area or areas may remain on after that for the first-stage pumping surface area has been turned off and the refrigerator has started to cool the cryopump. Water vapor then desirably condenses only on the refrigerator-cooled first-stage pumping surface area. Once the temperature of the first-stage pumping surface area has dropped below −50° C., the heater for the second-stage pumping surface area or areas is turned off so that the second-stage pumping surface area or areas can also be cooled. This prevents contamination of, particularly, the adsorbent of the second-stage pumping surface area with water.

The startup time of the pump should be selected on the basis of the gases which are to be pumped. It may be as long as 24 hours, for example, when high helium pumping capacity is to be achieved.

The startup time may be shortened by turning on the refrigerator while the housing is being evacuated and the pumping surface area or areas heated according to the method. The heater or heaters for the pumping surface area or areas then must have a capacity to compensate for the cold produced by the refrigerator, preferably through a control system, so that the pumping surface area or areas reach and remain at the desired temperature. Electric current resistance heaters in thermal contact communication with the pumping surface area or areas are preferred.

BRIEF DESCRIPTION OF THE DRAWING

Further advantages and details of the invention will now be described with reference to the accompanying drawing which is a schematic of a merely-exemplary, preferred embodiment of the invention.

DESCRIPTION OF THE PREFERRED EMBODIMENT

The cryopump shown in the drawing has a housing 1 with an inlet opening 2 for the gases to be pumped from a chamber or receiver 30 to be evacuated. The receiver 30 is sealingly attached to the cryopump by flanges 3 of a shut-off device 31 such that the cryopump 1 can be started according to the method before it is operatively connected to the receiver 30 to be evacuated.

A two-stage refrigerator 4 projects into the housing 1, from below as shown. A further, substantially cup-shaped housing 7 is mounted on a cooling head 5 of the first stage 6 of the refrigerator 4 with good thermal contact communication therewith and its opening 8 adjacent and approximately parallel to the opening 2 into the housing 1. A strip of metal serves as a shield or baffle 9 between the openings 2, 8. The walls of the housing 7 provide a pumping surface area for the first refrigerator stage for removing, particularly, water vapor and carbon dioxide. Moreover, the cup shape of the housing 7 optimally shields components disposed therein as described below and the baffle 9 from external heat radiation.

One of the heat-shielded components is the second stage 10 of the refrigerator 4 which projects into the cup-shaped housing 7 to a cooling head 11 at the housing openings 2,8. The cooling head 11 carries two, flat, sheet-metal sections disposed parallel to each other to provide pumping surface areas 12,13 of the second refrigerator stage. For enlarging these pumping surface areas and/or improving the pumping of light gases by cryosorption, the sheet-metal sections are coated on their inner, facing and, thus, "detour" arranged pumping surface area 13 with an adsorbent. The latter is preferably a molecular-sieve material like activated charcoal or a zeolite, for example. Gases are, however, also adsorbed and absorbed on the other, outside pumping surface area 12 of the second-stage pumping-surface metal section by cryocondensation and cryotrapping.

The housing 1 of the cryopump shown is provided with two further pipe connections 14 and 15. A roughing vacuum pump 18, preferably a rotary-vane vacuum pump with an ultimate pressure of about $10^{-3}$ mbar, is sealingly connected to pipe connection 14 through a valve 16 and an adsorption trap 17.

Pipe connection 15 admits electric current input leads 21 and 22 into the housing 1 for operating electric, resistance heaters 23 and 24 which are disposed, respectively, on the cooling heads 5 and 11 of the first and second refrigerator stages. Pipe connection 15 further serves as the mount for a controller 25 connected to the input leads 21, 22 to set, maintain and adjust the temperature of the heaters 23 and 24. To this end, the controller is provided with a blind flange 26 that is sealingly attached to a flange 27 about the pipe connection 15. This arrangement makes it impossible for the user to operate the cryopump without the controller 25 because removing the controller from the housing vents the pump so that it can no longer perform its function.

A power source 28 for the heaters 23,24 and controller 25 is connected to the controller.

To operate the cryopump according to the method, the shutoff device 31 between the pump housing 1 and the receiver 30 to be evacuated is closed. Then the roughing vacuum pump 18 and valve 16 are operated to evacuate the housing 1 to a pressure of from $10^{-2}$ to $10^{-3}$ mbar and, at the same time, the heaters 23,24 are turned on via controller 25 to heat the pumping surface areas 7,12,13 to the desired temperature of about 70° C., for example. The refrigerator may be turned on at this time, too, to prepare it for its cooling operation when either of the heaters is turned off. This condition is maintained until the helium pumping capacity of the pump is maximized as determined emperically or by calculation well within the skill in the art.

The controller 25 then turns off the heater 23 of the cooling head 5 of the first stage 6 of the refrigerator 4 which is turned on now if it was not before. The valve 16 is also closed at this time or, in any event, preferably before the cryopump is operatively connected to the receiver 30. The pumping surface area 7 therefore cools off sufficiently to pump water vapor from the housing 1. After this, the heater 24 of the cooling head 11 of the second stage 10 of the refrigerator 4 is also turned off so that its pumping surface areas 12,13 also reach their operating temperature of about 12° K., for example. Only then is the shutoff device 31 opened to connect the cryopump 1 operatively to the receiver 30 to be evacuated.

This procedure offers the advantage that in the initial cooling-down phase during which vapors are produced these are reliably prevented from being adsorbed on the second-stage pumping surfaces, thereby drastically reducing their capacity. The major portion of the vapors thus is initially adsorbed only on the pumping surfaces 7. Only when light gases, and primarily helium, are to be preferentially pumped are the pumping surfaces 12 cooled to their operating temperature so that the full pumping capacity is available there.

Surprisingly, with two-stage refrigerators it is possible to cool the first-stage pumping surfaces to their operating temperature while still maintaining the second-stage pumping surfaces at relatively high temperatures. The reason for this is that the thermal conductivity between the cooling head 5 of the first stage and the cooling head 11 of the second stage of the refrigerator is very low so that heating of the second stage has only a negligible effect on the temperature of the first stage.

The cryopump illustrated and described further permits the selective removal of hydrogen, helium and/or neon as well as of argon and other condensed permanent gases from the pumping surfaces of the second stage. To this end, the second-stage pumping surfaces are heated to 40 K. and 100 K., respectively, while the refrigerator is in operation. Before this is done, the connection to the receiver 30 must be closed and that to the roughing pump 18 opened so that the desorbed gases are pumped away and do not stream back into the receiver 30.

Startup is advantageously performed by the following procedure:

1. The roughing valve 16 is opened so that a pressure of less than $5\times10^{-2}$ mbar develops in the housing 1.

2. The heating means 24 of the first stage 10 is cut in, and the second stage is maintained at a temperature of 70° C. for a few hours.

3. The refrigerator 4 is turned on and the first stage is thus cooled to a temperature of less than 160 K.

4. The roughing valve 16 is closed.

5. The heating means 24 of the first stage 10 is cut out so that the second stage cools down to a temperature of less than 20 K.

6. The shutoff device 31 to the receiver 30 is opened.

Complete regeneration involves the following steps:

1. The shutoff device 31 to the receiver 30 is closed.

2. The refrigerator 4 is turned off.

3. The roughing valve 16 is opened at a pressure higher than $5\times10^{-2}$ mbar.

4. The heating means of the first and second stages are cut in and operated at 70° C. until a pressure of less than $5\times10^{-2}$ mbar develops in the pump.

5. The heating means of the first stage is cut out.

6. The refrigerator is turned on so that the first stage cools down to a temperature of less than 160 K.

7. The roughing valve 16 is closed.

8. The heating means 24 of the second stage 10 is cut out so that the second stage cools to a temperature of less than 20 K.

9. The shutoff device 31 to the receiver 30 is opened.

Regeneration of the cryopump saturated with He and $H_2$ is carried out by the following procedure:

1. The shutoff device 31 is closed.

2. The roughing valve 16 is opened at a pressure higher than $5\times10^{-2}$ mbar.

3. The heating means 24 of the second stage 10 is cut in while the refrigerator is in operation, and a heating temperature of 70 K. is maintained until a pressure of less than $5\times10^{-2}$ mbar has developed in the pump housing.

4. The roughing valve 16 is closed.

5. The heating means 24 of the second stage 10 is cut out so that the second stage cools to a temperature of less than 20 K.

6. The shutoff device 31 to the receiver is opened.

It will be appreciated that the instant specification and claims are set forth by way of illustration and not of limitation, and that various changes and modifications may be made without departing from the spirit and scope of the present invention.

What is claimed is:

1. A method for one of starting and regenerating a cryopump having a housing operatively connectable to a space to be evacuated with the cryopump, a two-stage refrigerator in the housing, and means providing a pumping surface area in thermal communication with each stage of the refrigerator for at least one of gas-pumping adsorption and absorption thereon when the refrigerator is operated, comprising:

evacuating the housing to a pressure of from about 1 to about $10^{-3}$ mbar and heating at least the pumping surface area of the second stage of the refrigerator at least just before the cryopump is operatively connected to the space to be evacuated with the cryopump at least sufficiently to prevent gas adsorption and absorption thereon.

2. The method of claim 1, wherein the heated pumping surface area is coated with an adsorbent and the heating comprises heating the coated pumping surface area to about 70° C.

3. The method of claim 2, and further comprising heating the pumping surface area of the first stage of the refrigerator to about 70° C. at the same time as the evacuating the housing and heating the pumping surface area of the second stage.

4. The method of claim 3, and further comprising operating the refrigerator while evacuating the housing and heating the pumping surface area of the second stage.

5. The method of claim 4, and further comprising heating the pumping surface area of the first stage of the refrigerator and then stopping the heating of the pumping surface area of the first stage before stopping the heating of the second stage while operating the refrigerator.

6. The method of claim 2, and further comprising operating the refrigerator while evacuating the housing and heating the pumping surface area of the second stage.

7. The method of claim 6, and further comprising heating the pumping surface area of the first stage of the refrigerator and then stopping the heating of the pumping surface area of the first stage before stopping the heating of the second stage while operating the refrigerator.

8. The method of claim 1, and further comprising heating the pumping surface area of the first stage of the refrigerator to about 70° C. at the same time as the evacuating of the housing and heating of the pumping surface area of the second stage.

9. The method of claim 8, and further comprising operating the refrigerator while evacuating the housing and heating the pumping surface area of the second stage.

10. The method of claim 9, and further comprising heating the pumping surface area of the first stage of the refrigerator and then stopping the heating of the pumping surface area of the first stage before stopping the heating of the second stage while operating the refrigerator.

11. The method of claim 1, and further comprising operating the refrigerator while evacuating the housing and heating the pumping surface area of the second stage.

12. The method of claim 11, and further comprising heating the pumping surface area of the first stage of the refrigerator and then stopping the heating of the pumping surface area of the first stage before stopping the heating of the second stage while operating the refrigerator.

13. A method of regenerating a cryopump having a housing operatively connectable to a space to be evacuated with the cryopump, a two-stage refrigerator in the housing, and means providing a pumping surface area in thermal communication with each stage of the refrigerator for at least one of gas-pumping adsorption and absorption thereon when the refrigerator is operated after operating the cryopump, comprising:

closing the operative connection of the housing to the space to be evacuated, heating the pumping surface area of the second stage of the refrigerator to about 40° K. for desorption of any hydrogen, helium and neon thereon to a gas, and providing at least 1 mbar of vacuum to the housing for removing the desorbed gas.

14. The method of claim 13, and further comprising heating the pumping surface area of the second stage of the refrigerator to about 100° K. for desorption of any argon and like condenses, permanent gases thereon to a gas.

15. A cryopump, comprising:

a housing;

means for operatively connecting the housing to a space to be evacuated with the cryopump;

a two-stage refrigerator in the housing;

means providing a pumping surface area in thermal communication with each stage of the refrigerator for at least one of gas-pumping adsorption and absorption thereon when the refrigerator is operated;

means for providing a pressure of from about 1 to about $10^{-3}$ mbar to the housing when it is not operatively connected to the space to be evacuated and the refrigerator is not operating; and means for heating at least the pumping surface area in thermal communication with the second stage of the refrigerator.

16. The cryopump of claim 15, and further comprising controller means for controlling the temperature of the means for heating at least the pumping surface area in thermal communication with the second stage of the refrigerator.

17. The cryopump of claim 16, and further comprising means mounting the controller means on the housing for venting the housing when the controller means are dismounted from the housing.

* * * * *